US008549780B2

(12) United States Patent
Emde et al.

(10) Patent No.: US 8,549,780 B2
(45) Date of Patent: Oct. 8, 2013

(54) SAFETY DEVICE FOR FIREARMS AND METHOD FOR SECURING FIREARMS PROVIDED WITH A SAFETY DEVICE

(75) Inventors: Dietmar Emde, Arnsberg (DE); Karl-Friedrich Giebel, Brannenburg (DE)

(73) Assignees: Armatix GmbH, Unterfohring (DE); German Sport Guns GmbH, Ense-Hoingen (DE)

( * ) Notice: Subject to any disclaimer, the term of this patent is extended or adjusted under 35 U.S.C. 154(b) by 414 days.

(21) Appl. No.: 12/921,654

(22) PCT Filed: Mar. 11, 2009

(86) PCT No.: PCT/EP2009/001731

§ 371 (c)(1), (2), (4) Date: Nov. 30, 2010

(87) PCT Pub. No.: WO2009/112244

PCT Pub. Date: Sep. 17, 2009

(65) Prior Publication Data

US 2011/0061280 A1 Mar. 17, 2011

(30) Foreign Application Priority Data

Mar. 12, 2008 (EP) ..... 08 00 4590

(51) Int. Cl.
*F41A 17/00* (2006.01)

(52) U.S. Cl.
USPC ..... 42/70.01; 42/70.06; 42/70.04; 42/70.08; 89/150; 89/27.12

(58) Field of Classification Search
USPC ..... 42/70.01, 70.06, 70, 70.08; 89/150, 89/27.12
See application file for complete search history.

(56) References Cited

U.S. PATENT DOCUMENTS

| | | | | |
|---|---|---|---|---|
| 4,682,435 | A | 7/1987 | Heltzel | 43/70.01 |
| 5,088,222 | A | 2/1992 | Larson | 43/70.04 |

FOREIGN PATENT DOCUMENTS

| | | |
|---|---|---|
| CH | 213 931 | 3/1941 |
| EP | 1 074 810 | 2/2001 |
| WO | WO 2005/005908 | 1/2005 |

OTHER PUBLICATIONS

Communication from European Patent Office for European Application No. 09720042.2, dated Sep. 21, 2012, 5 pgs.
International Search Report and Written Opinion from related application Serial No. PCT/EP2008/001731, dated Aug. 10, 2009.

*Primary Examiner* — J. Woodrow Eldred
(74) *Attorney, Agent, or Firm* — Westman, Champlin & Koehler, P.A.

(57) ABSTRACT

The present invention relates to a safety device for a firearm with a trigger bar in said firearm. The trigger bar moves in response to a pulling of a trigger. An actuator in said firearm is adapted to actively move said trigger bar between a first position and a second position. The trigger bar engages in the trigger induced movement with a hammer link for releasing a hammer and firing a cartridge bullet when the trigger bar is in the first position or first state. However, said trigger bar does not engage in the trigger induced movement with the hammer link, such that the cartridge bullet is not fired, when the trigger bar is in the second position or state.

14 Claims, 7 Drawing Sheets

SAFETY DEVICE FOR FIREARMS AND METHOD FOR SECURING FIREARMS PROVIDED WITH A SAFETY DEVICE

CROSS-REFERENCE TO RELATED APPLICATION

This Application is a Section 371 National Stage Application of International Application No. PCT/EP2009/001731, filed Mar. 11, 2009 and published as WO 2009/112244 on Sep. 17, 2009, in English, the contents of which are hereby incorporated by reference in their entirety.

The present invention generally relates to firearms or weapons including a safety device for preventing firing of the firearm by an unauthorized user. In particular, the present invention provides a safety mechanism which is preferably controllable by a transmitter, responder and/or a transponder.

Firearms are used in various fields, e.g., in the police service, the security service, the military service, in riflemen's associations, hunters' associations and in the private field. In commonly known firearms usually each person can fire a firearm by simply releasing the safety of the firearm. Thus, it is not possible to prevent firing of the firearm by persons who are not allowed to do so. Several attempts have been made in the prior art to prevent that a firearm can be fired by an unauthorized user.

There are known firearms which have been designed with authorization systems. Such systems verify whether a user is permitted to fire the firearm or not. Typically, these systems block the trigger or block mechanical parts such that the trigger cannot be pulled. However, blocking mechanical parts may cause a damage due to deformed parts when a user pulls with an increased force at the trigger.

WO 2005/005908 relates to an authorization system for a firearm which includes an authorizing device worn by the authorized user, and a firearm with a fire control system, a computer controller, and a piezoelectric disabler. An enabler has two members that cooperate to disrupt the fire control system: a first member, that has a movable state and a fixed state, and a second member, that is attached to a frame and contains piezo-electric material. When the fire control system is not disrupted, i.e., the firearm is in the enabling state, the first member is in a movable state. The pulling of the trigger causes the first member to move. In other words, a part of the force provided by the user to pull the trigger is used to move the first member. Since such a movement always provides friction losses, such a safety device influences the trigger force which is needed to fire the firearm.

It is the object of the present invention to provide a safety device and a safety system, preferably with a transponder for authenticating at least one authorized user and a method for securing a firearm, preferably a pistol, which can be handled easily, quickly and reliably and overcomes the problems known from prior art safety devices.

This object is achieved by a safety device according to claim 1 and a safety system according to claim 12. Additional preferred embodiments are described in the dependent claims.

A safety system/safety device according to the present invention is adapted to determine whether a user is an authorized user, and, if so, to permit the firearm to be fired. If not authorized, the user will not be able to fire the firearm. The safety system/safety device comprises authorization means, preferably electronic means, for performing the authorization step. The authorization means controls the safety device according the present invention, wherein the safety device preferably comprises mechanical or electromechanical components for enabling or disabling the mechanical firing mechanism in the firearm.

The safety device of the present invention preferably comprises an electromechanical safety mechanism with an electromechanical actuator. An actuator transforms an input signal, such as an electrical signal, into a motion. An electronic control unit preferably controls the actuator. The electronic control unit or an additional electronic circuit (authorization means) controls the authentication of an authorized user. The actuator is used to interact with the so called "ignition chain" (in German: Anzündkette), and preferably interrupts the ignition chain such that a discharge of the firearm is prevented. The term ignition chain refers to the kinematical operation of connected mechanical components which translate a force applied to the trigger to the release of the firing pin, which finally strikes the primer of a cartridge.

The term "ignition chain", as used in the present application, preferably refers to the operation of parts which translate an applied force to the trigger to strike the firing pin. The ignition chain starts with the pulling of the trigger up to the release of the firing pin which strikes the primer of a cartridge. An interruption of the ignition chain refers to an interruption of at least a movement of a mechanical part such that even if the trigger is pulled to the rear end the force will not be transferred to fire the firing pin. In other words, an interruption may redirect a force of a mechanical part such that the trigger can be pulled to the rear end but the force does not translate into the striking of the cartridge. According to the present invention it is preferred that the ignition chain is not blocked and the force for firing the firearm is redirected such that the ignition chain is interrupted. For instance, a mechanical component which is involved in the ignition chain may be moved or earned away such that an engagement with the subsequent component is not possible.

In the following the term "firearm" is used for all kinds of firearms or weapons up to Cal. 20 mm, independent of the firemode "Single or automatic" fire.

The term "actuators" refers to devices which transform an electrical input signal into motion. Electrical motors, ultrasonic motors, relays, comb drive, piezoelectric actuators, thermal bimorphs, shape memory alloys, digital micromirror devices and electroactive polymers are some examples of such actuators.

Firearms typically utilize triggers to initiate the firing of a cartridge or round in the firing chamber of the firearm. This is accomplished by actuating a striking device through a combination of spring and kinetic energy operating through a firing pin to strike and ignite the primer of the cartridge (see ignition chain as defined above). There are two major types of striking mechanisms, i.e., hammers and strikers. Hammers are typically spring-tensioned masses of metal that preferably pivot on a pin when released and strike a firing pin to discharge a cartridge. Strikers are, substantially, spring-loaded firing pins that travel on an axis in-line with the cartridge eliminating the need for a separate hammer. The present invention may be provided with any kind of strikers. However, in the following an exemplary embodiment of the present invention will be described with respect to a pistol which comprises a hammer in a hammer mechanism. Thus, even though the term hammer link will be used throughout the description, it is clear to a person skilled in the art that the term hammer link refers to the mechanism, which transfers the force from a trigger bar to the striker (hammer link or striker link may be used synonymously) such that the hammer of striker is released. There are a plurality of connecting parts and corresponding mechanisms between the trigger and the thing pin. In the following, however, only the mechanical interactions of the parts which are involved in the primary steps of the ignition chain will be discussed in detail, i.e., until the trigger bar engages with a hammer link or striker link.

The connection between the trigger bar and the hammer (or striker) is often referred to as the sear or sear surface. Variable mechanisms will have this sear or sear surface directly on the trigger bar and/or hammer (striker) or have separate sears or other connecting parts. In other words, there exist a plurality of mechanism for cocking and/or releasing a hammer or striker. The present invention is not limited to any specific hammer cocking and/or releasing mechanism. According to the present invention, the (mechanical) link or the connection between a trigger bar and a subsequent mechanism, which may either cock and release a hammer (double action) or may only release the hammer (single action), should be interrupted. Said subsequent mechanism is labeled hammer link or hammer means for the rest of the present application. For instance, FIGS. 1 to 6 show at reference sign 3 simplified and schematically a mechanical part, which represents such a hammer link or hammer means. In other words, the hammer link 3 may be a part of the hammer itself, i.e., the trigger bar engages with the hammer itself such that the hammer is e.g. cocked and released (double action). The hammer link 3, however, could also be a part of the hammer mechanism like the sear such that the cocked hammer is merely released when the trigger bar engages with the hammer link.

The safety device according to the present invention is adapted to interrupt at least at one point the operation of the plurality of connecting parts, corresponding mechanisms and/or kinematic energy operations between the trigger and the firing pin, i.e., the safety device is adapted to interrupt the ignition chain in case the user is not authorized. The interruption of the ignition chain can occur at any location. According to the present invention, it is preferred that the link or connection between the trigger bar and the hammer link is interrupted.

According to a preferred embodiment of the present invention, the safety device may be provided within the receiver, wherein an actuator couples with the trigger bar such that said trigger bar engages with the hammer link. When the safety device is in the authorized state and the trigger bar does not engage with the hammer link when the safety device is in the unauthorized state or safety state. The safety mechanism preferably interrupts the mechanism of the ignition chain such that any force applied to the trigger will not be forwarded to a subsequent component such that the trigger may be pulled backwards, but without an effect on the firing pin, i.e., the ignition chain is interrupted.

According to a first aspect, the present invention relates to a safety device for a firearm which comprises a trigger bar between a trigger and a hammer link (striker link or hammer means). The trigger bar moves in response to a pulling of a trigger. An actuator in said firearm is adapted for actively moving said trigger bar between a first position (state) and a second position (state). The trigger bar engages in the trigger induced movement with the hammer link (striker link, hammer means) for releasing a hammer and firing a cartridge bullet when the trigger bar is in the first position or first state. However, said trigger bar does not engage in the trigger induced movement with the hammer link (striker link, hammer means), such that the cartridge bullet is not fired, when the trigger bar is in the second position or state. In other words, when the trigger bar is in the second state/postion (also referred to as "safety state" or "safety position"), the trigger bar preferably does not engage with the hammer link. The connection or the link (i.e., the link which would normally occur when the trigger bar moves to the hammer link) between the trigger bar and the hammer link is interrupted or avoided. Still in other words, the trigger bar may pass by the hammer link. The trigger bar moves idly or moves freely or contactless with regard to the hammer link. It is therefore preferred that the movement of the trigger bar is not blocked but only idle.

According to a preferred embodiment of the present invention, the actuator is at least one of the group consisting of a mechanical actuator, an electromechanical actuator, a one-wire element comprising a shape memory alloy, an electric motor, a piezoelectric actuator, a magnet and an electromagnet.

The actuator preferably moves or displaces the trigger bar from the first position or state to the second position or state by means of a lever means, wherein said lever means is movable by said actuator. In other words, when the trigger bar is in the first position or state a normal firing of the firearm is possible. When the trigger bar is displaced from the first position such that the trigger bar does not engage the hammer link, the firearm is in the safety position such that the firearm can not be fired. The actuator is adapted for actively moving the trigger bar, via the lever means, between the two positions (states) back and forth dependent on the present authorisation status.

According to yet a further favourable embodiment, a trigger bar spring element is provided between the lever means and the trigger bar. Said trigger bar spring element is preferably arranged such that the trigger bar spring element applies a force between the trigger bar and the lever means. In particular, it is preferred that the force between the trigger bar and the lever means is substantially equal irrespective of whether the trigger bar is in the first position or in the second position.

According to still another preferred embodiment, the lever means is connected with a rotatable lever element or a cam or cam element which engages with the trigger bar. This lever element is preferably adapted for moving the trigger bar between the first and second position by rotational movement of the rotatable lever element. It is further preferred that the connection between the lever element and the trigger bar is a mere abutment, i.e., the lever element abuts against the trigger bar.

The rotatable lever element preferably comprises a rotation axis and a working point or working axis displaced from the rotation axis. This working point or working axis is preferably connected to the lever means such that a movement of the lever means results in a rotational movement of the rotatable element around the rotation axis.

The rotational lever element is preferably a can element. The trigger bar and the rotational lever element engage or abut preferably via substantially planar surfaces when the trigger bar is in the first state or first position. It is further preferred that the abutment or engagement between the trigger bar an the lever element is aganged such that a small rotational movement of the rotational lever element results in a larger vertical movement of the trigger bar. This effect may be achieved with a lever action, e.g. by using two different axis of the lever element, the first axis as axis of rotation and the other axis as working point or fulcrum. In other word, increasing the distance between these two axes increases the lever effect.

It is further preferred that the working point (or working axis) and the rotational axis (axis of rotation) are in line with the lever means when the trigger bar is in the second position. Such an arrangement ensures that the lever element is in a stable position.

The lever means may comprise a frame for movably supporting a spring support element. The spring support element is preferably adapted to transfer forces from the trigger bar via the trigger bar spring element to the frame and vice versa.

The spring support element may comprise a support pin such that the support element engages with or abuts against the trigger bar via said support pin.

According to yet a further preferred embodiment, a bushing is provided around said support pin such that the support element engages with or abuts against the trigger bar via said support pin and said bushing.

The present invention also relates to a safety system comprising a safety device as described above and a transponder for authenticating at least one authorized weapon/firearm user carrying or wearing the transponder or for authenticating an allowed area for using the weapon/firearm.

It is preferred that the transponder is adapted to emit a wireless preferably cryptified authenticating signal and preferably communicate with each other preferably wireless, more preferably by a bidirectional wireless signal transmission, preferably based on a Challenge response algorithm, even more preferably with a frequency of approximately 25 kHz or via blue tooth interfaces.

The transponder may comprise a switch for activating the transponder for a given period of time for emitting the authenticating signal.

The transponder may comprise a biometric sensor, preferably a fingerprint sensor, for identifying an authorized user before activating the transponder for a given period of time for emitting the authenticating signal.

The transponder may comprise keys for entering a personal code for identifying an authorized user before activating the transponder for a given period of time for emitting the authentication signal.

The transponder may be configured to provide an authenticating signal within a range of approximately up to 1.5 m, more preferably up to 13 m, more preferably up to 10 m, more preferably up to 5 m, even more preferably up to 1.5 m or more preferably up to 30 cm.

The transponder may be either a relatively small device to be constantly carried or worn by the user or a stationary device to be mounted in an area for using weapons, such as a shooting range/shooting-stand.

According to a further aspect, different transponders may be used for different users of the safety device.

The safety device may be adapted to permit firing of the firearm for a given number of shots or for a given period of time once it has received an authenticating signal from an authorized user, wherein the period of time preferably can be varied for different transponders of different users of the safety device.

The transponder may be adapted to also communicate with a compartment for weapons, such as a locker, in order to give an authorized person access to the compartment.

The transponder and/or the safety means may be programmable in order to authorize a user or a group of users.

The safety device/safety system may be programmable, preferably wireless, more preferably by a bidirectional wireless signal transmission, preferably based on a Challenge response algorithm, even more preferably with a frequency of approximately 25 kHz or via blue tooth interfaces.

It is further preferred that the request signal and/or the authenticating signal are communicated preferably wireless, more preferably by a bidirectional wireless signal transmission, preferably based on a Challenge response algorithm, even more preferably with a frequency of approximately 25 kHz or via blue tooth interfaces.

It is yet further preferred that activities of the transponder and/or the safety device are logged and readable by a computer.

If desired, a small light such as a light emitting diode (LED) may be provided at the firearm and/or the transponder to indicate that the firearm is ready to fire.

The present invention further refers to a method for releasing a secured firearm, e.g., a hand-held weapon with at least one of the following steps: providing a safety device according to the present invention in the firearm; providing a transponder which is adapted to emit a wireless preferably cryptified authenticating signal which authenticates at least one authorized firearm user or authenticates an allowed area for using the firearm; emitting the authenticating signal by the transponder to the safety device; receiving and processing the authenticating signal from the transponder at the safety device, and actively moving the trigger bar by means of an actuator to the first position (unlocked state or unlocked position) upon receipt of an authenticating signal from the transponder authenticating an authorized user such that firing of the firearm is permitted.

The present invention further refers to a method for securing a firearm, e.g., a hand-held weapon with at least one of the following steps: providing a safety device according to the present invention in the firearm; and when no authenticating signal (i.e., no signal or a wrong signal) is received by the safety device, actively moving the trigger bar by means of an actuator to the second position (safety position or safety state) such that firing of the firearm is not possible.

The present invention and the individual steps of locking and unlocking the firearm are described in more detail on the basis of the enclosed drawings.

FIG. 1 shows the safety device in a first state such that firing of the firearm is possible;

Figure 1:
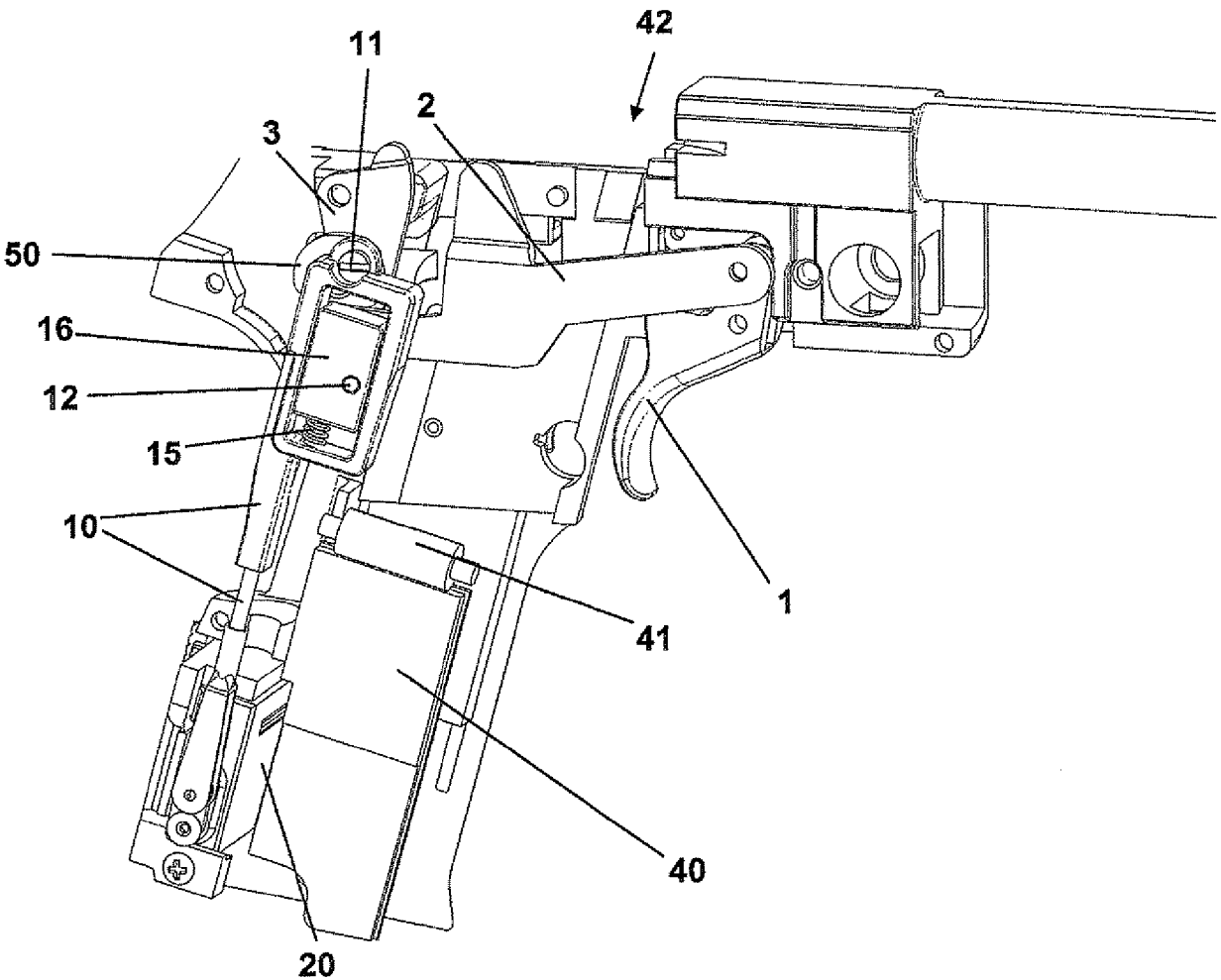
FIG. 1 shows a side view of a firearm according to a preferred embodiment of the present invention, in particular
Figure 4:
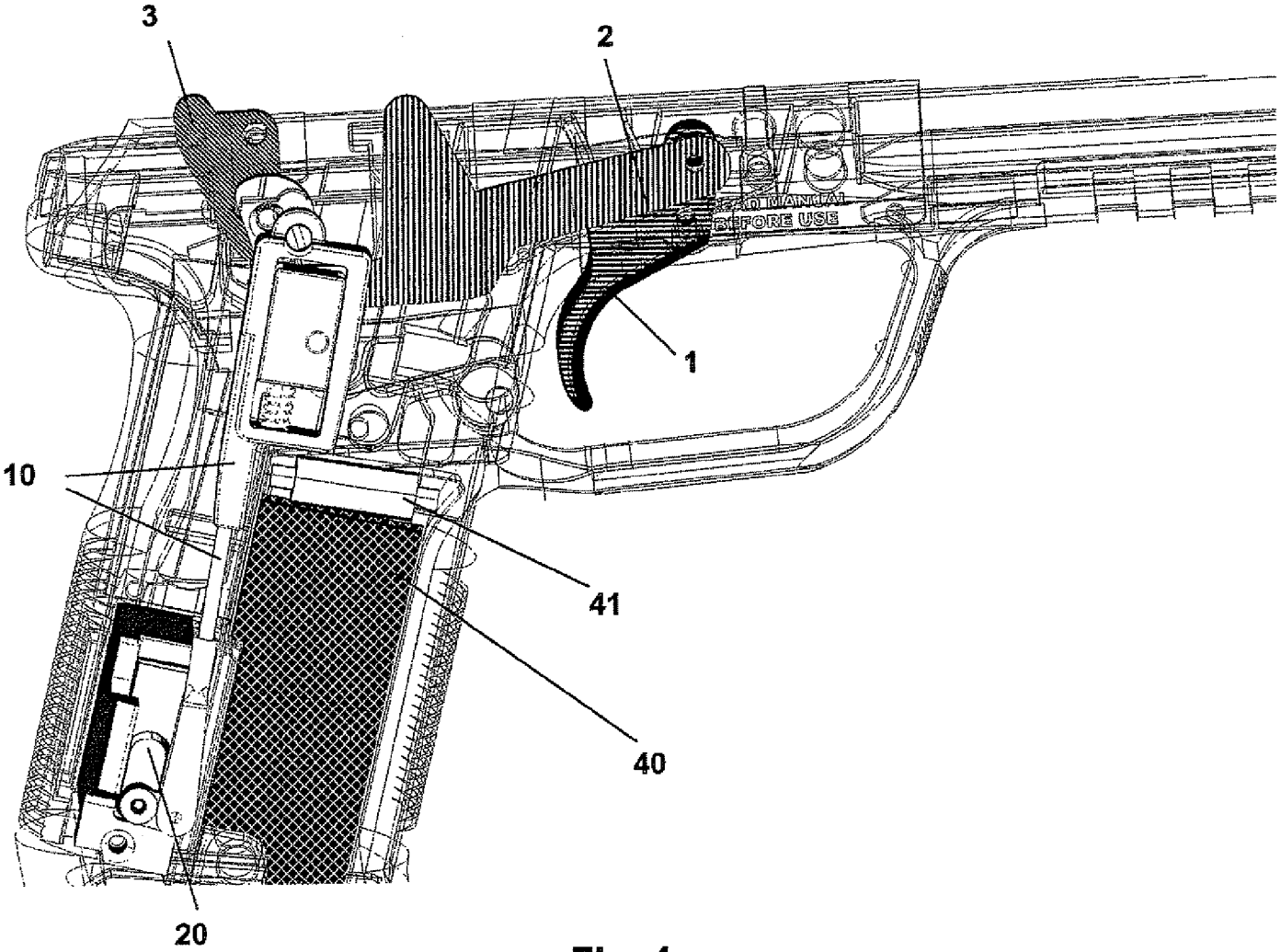
Figure 5:
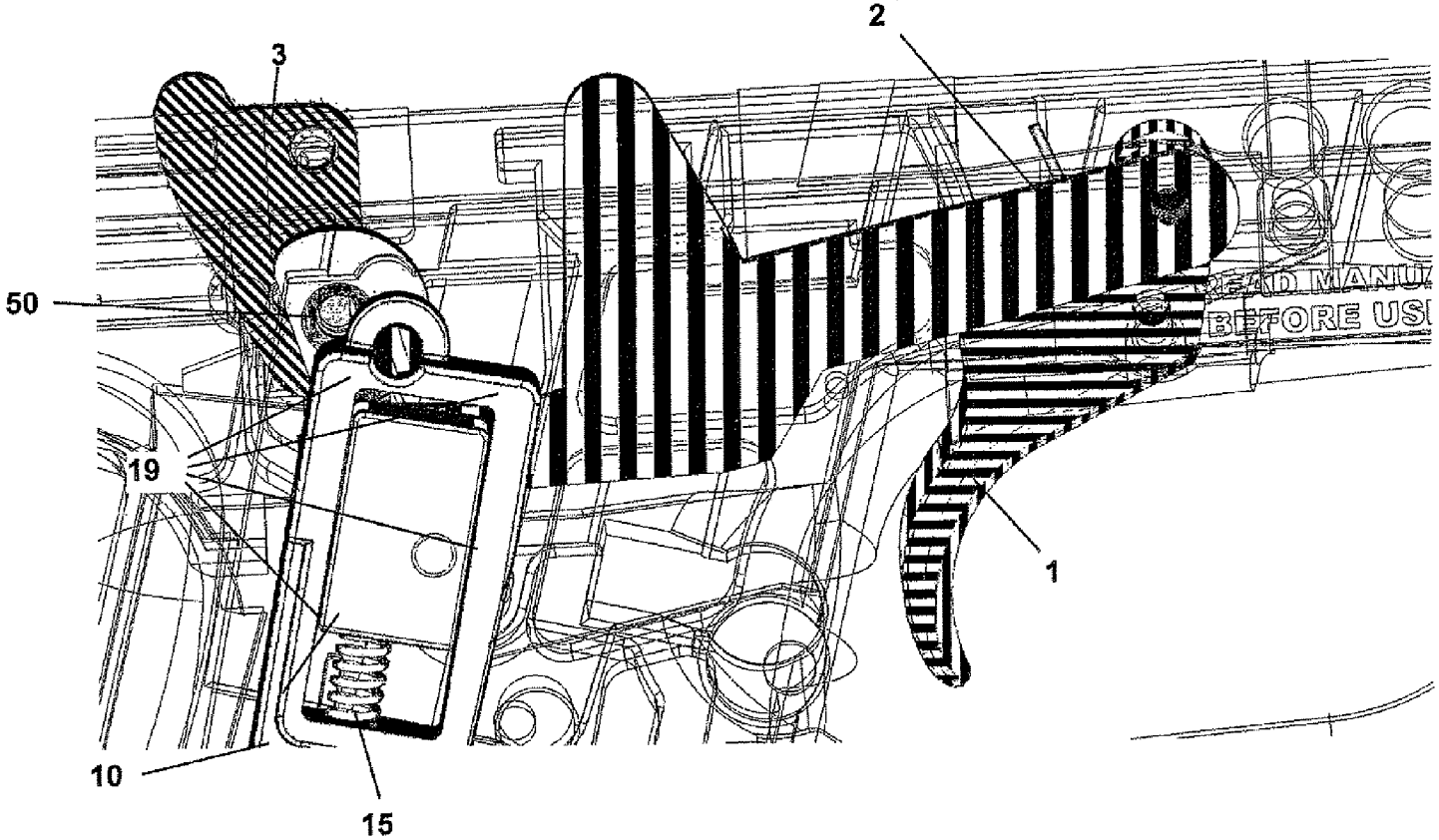
Figure 6:
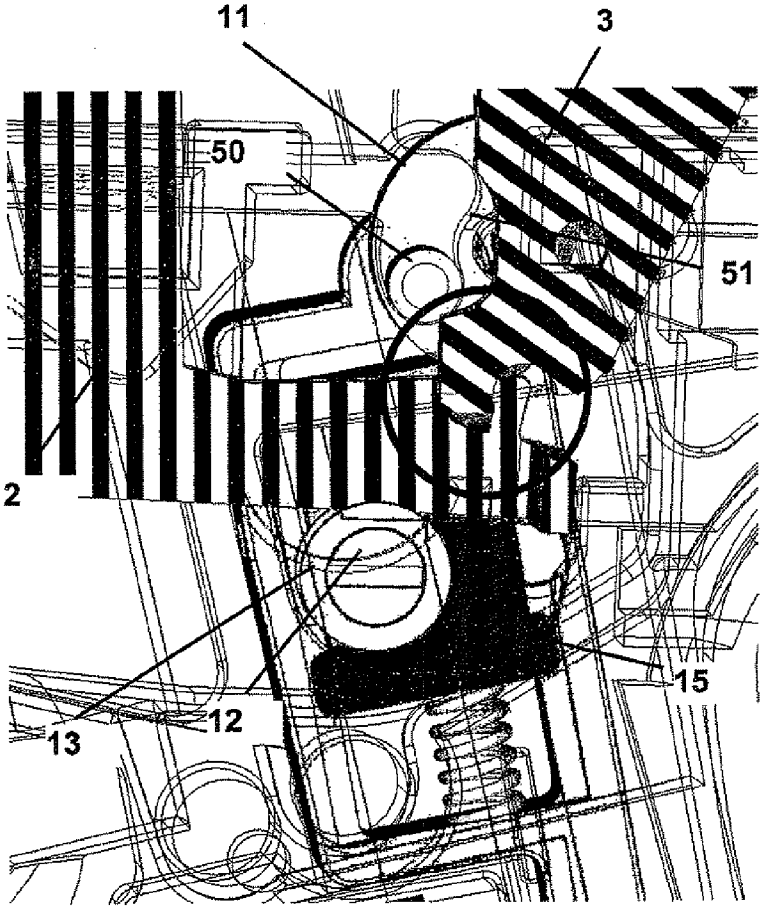
Figure 7:
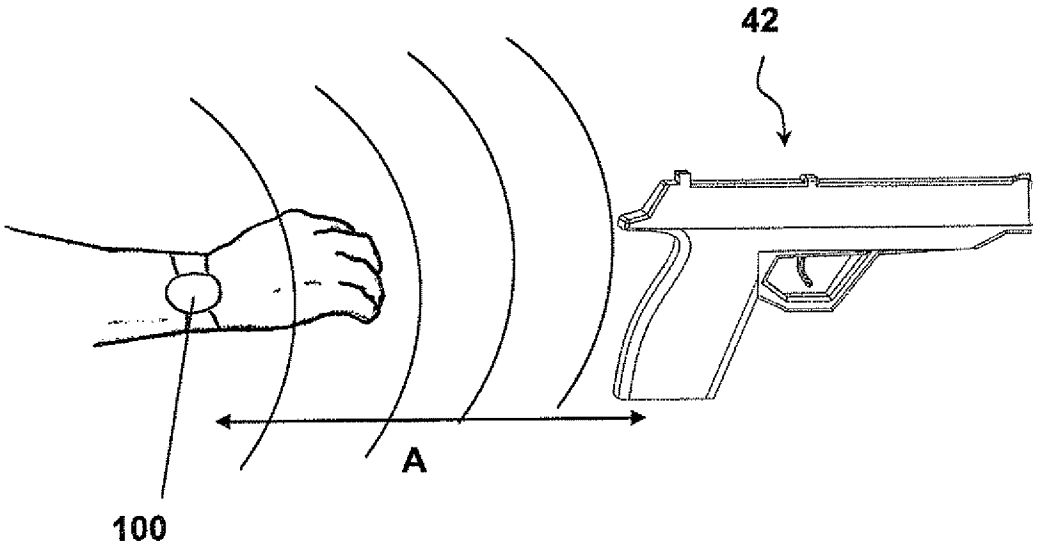

FIG. 4 corresponds to FIG. 1 but shows the safety device in a second state such that firing of the firearm is not possible;

FIG. 5 is an enlarged partial view of FIG. 4 showing the parts of a safety device according to the present invention in more detail;

FIG. 6 shows details of the safety device as shown in FIG. 5, but from the opposite side; and FIG. 7 shows an authentication via a transponder worn by a user in form of a wristwatch.

In the following the general function of a self-loading pistol will be exemplarily explained. In a loaded state a round or cartridge is in the cartridge chamber. The trigger is in the foremost position. When the trigger is pulled in the rearward direction (arbitrarily designating the handle-end of firearm as rearward), a trigger bar, which is connected to the trigger, is caused to move forwardly which subsequently gets into contact with a hammer. Thus, the pulling of the trigger is translated into movement of the hammer, via the trigger bar, until the hammer is released. The hammer then hits the firing pin, which strikes the primer and discharges the firearm.

In the following the function of a self-loading pistol with a safety device according to the present invention will be exemplarily explained with regard to FIG. 1. The depicted firearm 42 with a safety device according to the present invention determines (by means of an authorization means) whether a user is an authorized user, and, if so, permits the firearm to fire. If not authorized, the user will not be able to fire the firearm. Thus, when the safety device does not authorize a user to be authorized, the firearm 42 is in the locked state such that a firing of the firearm is not possible (see FIGS. 4, 5 and 6).

The firearm 42 comprises a trigger 1 which transfers a force via a trigger bar 2 to a hammer link 3, which eventually causes the hammer to fire a cartridge. In the following only the first parts which are involved in the "ignition chain" are discussed, i.e., the function of the hammer link, the hammer and the firing pin will not be explained in detail.

The safety device according to the present invention is preferably located within the receiver, for instance inside the handle of the firearm. The safety device comprises an actuator 20 which engages with the trigger bar 2 preferably via a plurality of mechanical components which will be discussed in detail later. The actuator is preferably an electromechanic actuator, e.g., an electromotor 20. A battery 40 is located in the receiver of handle for energizing the actuator 20. The actuator is controlled in response to an authentication signal, preferably provided by the authorization means The safety system according to the present invention is adapted to determine whether a user is an authorized user, and, if so, permits the firearm to be fired. If not authorized, the user will not be able to fire the firearm. The safety system/safety device comprises authorization means, preferably electronic means, for performing the authorization step. The authorization means controls the safety device according the present invention, wherein the safety device preferably comprises mechanical or electromechanical components for enabling or disabling the mechanical firing mechanism in the firearm.

Figure 2:
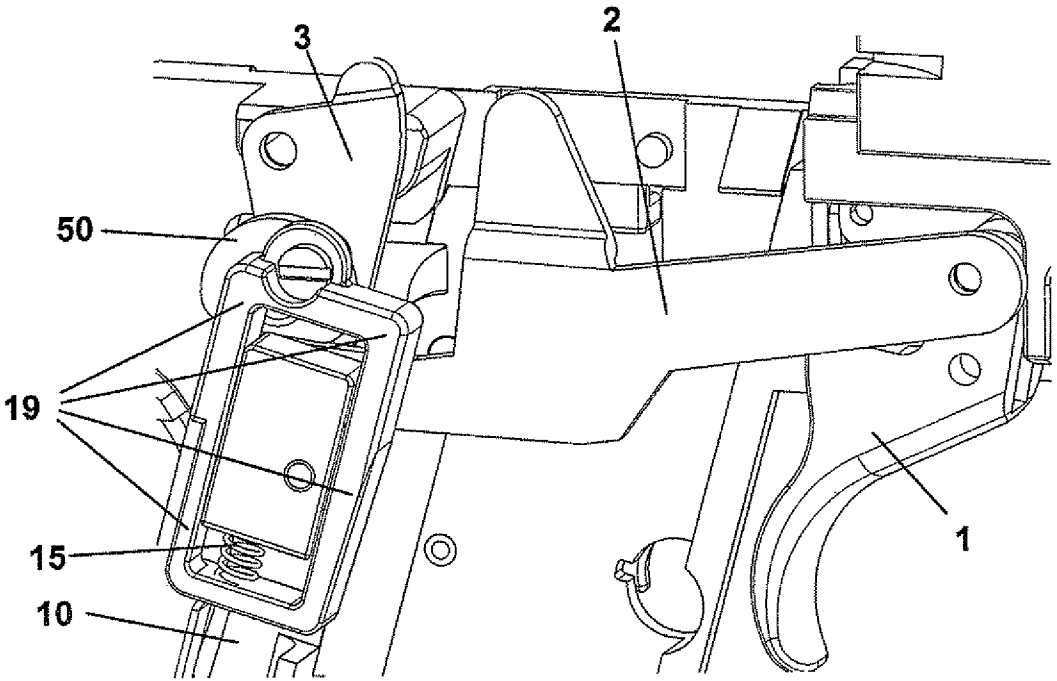
FIG. 2 is an enlarged partial view of FIG. 1 showing the parts of a safety device according to the present invention in more detail.
Figure 3:
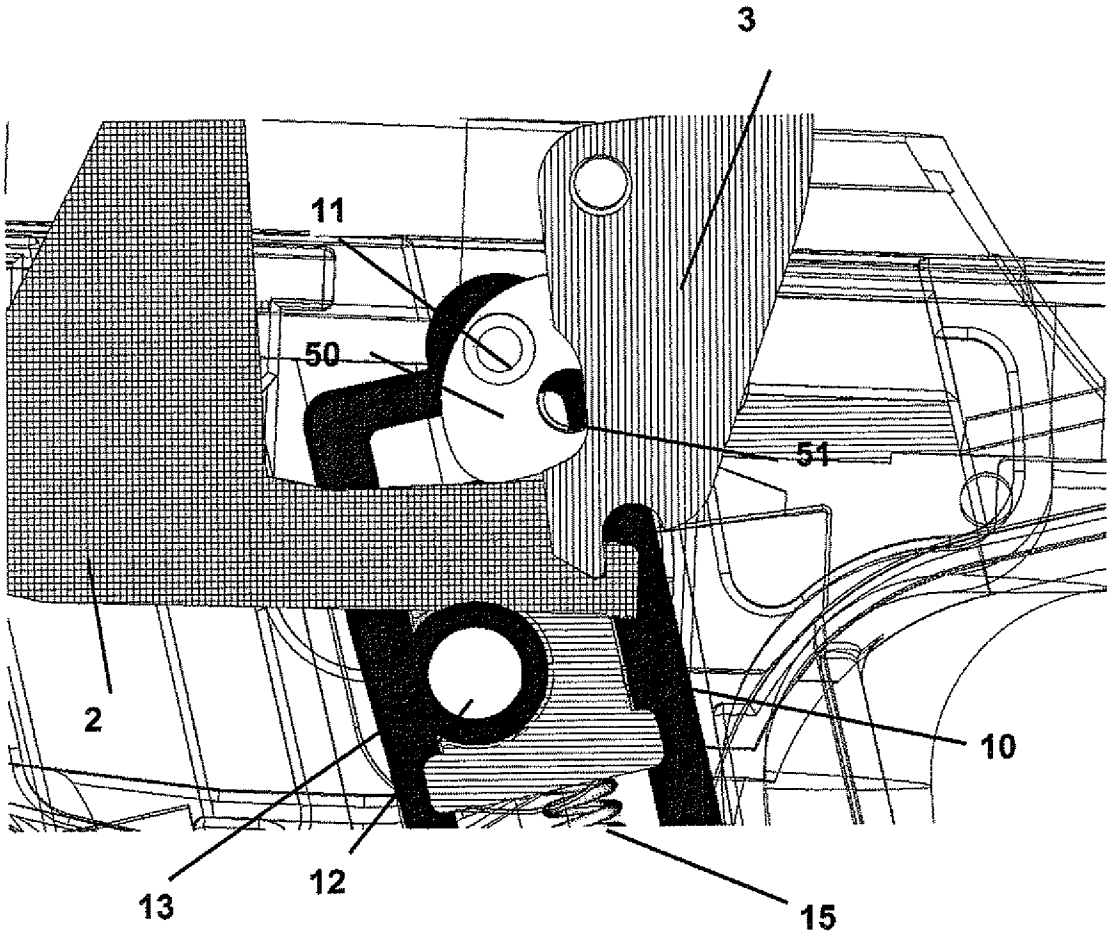
FIG. 3 shows details of the safety device as shown in FIG. 2 but from the opposite side.

For instance, authentication may be achieved by means of a wireless transponder 100 (see FIG. 7). An antenna 41, e.g., a ferrite antenna, may therefore be provided in the receiver for the wireless communication with the transponder 100. When a user is authorized, e.g., by means of transponder 100, the authorization means (not explicitly shown) controls the actuator 20 to move a trigger bar 20 (from the second or safety position) to the first (enabling) position as shown in FIGS. 1 to 3. The trigger bar 2 is located in an "upper position" such that a normal use of the firearm is possible, i.e., the pulling of the trigger 1 is transferred to a movement of the trigger bar 2 which eventually engages with the hammer link 3. In the depicted embodiment a rearward pulling of the trigger 1 moves the trigger bar 2 to the front direction (the handle is considered in the application as rear and the muzzle as front) such that the hammer link 3 is pulled to the front direction for firing a cartridge. However, depending on the position and the number of fulcrum pins, there exist also mechanisms where the trigger bar 2 moves rearward in response to the rearward pulling of the trigger 1. When the trigger bar 2 moves rearward, it comes into contact with the hammer link 3 attached to the hammer, moving it rearward as well. In both designs, the hammer link 3 loads the hammer against a hammer spring until hammer link trips, releasing the hammer, which in turn propelled forward at the urging of the hammer spring. The propelled hammer strikes the firing pin that therefore strikes the primer of a cartridge present in the breech block, detonating the powder in the cartridge base. The exploding powder propels the cartridge bullet through the barrel.

It should be noted that the above described mechanism of the ignition chain is simplified and more complicated individual steps ensure for example that only one cartridge is fired when the trigger is pulled etc. These specific details will not be discussed. However, it should be noted that the movement of the trigger bar 2 is typically not a mere forward and backward movement. For some reasons it is preferred that the trigger bar also moves up and down during the back and forth movement. In order to ensure that the trigger bar 2 engages with the hammer link 3 (which is preferably positioned above the trigger bar 2), it is preferred that an upwardly directed (biasing) force is applied at the trigger bar 2. Such an upwardly directed force may be achieved by a tension or pull spring mounted e.g. above the trigger bar or by a pressure spring mounted below the trigger bar. This spring will be labeled "trigger bar spring element" in the following. In particular, it is preferred that the trigger bar spring 15 provides a sufficient force to the upward direction.

When a user is not authorized, the authorization means (not explicitly shown) controls the actuator 20 to move the trigger bar 2 from the first position (as shown in FIGS. 1 to 3) to the second position (shown in FIGS. 4 to 6), i.e., the firearm is in a locked state and firing is not possible. The trigger bar 2 is located in a "lower position" such that the engagement between the trigger bar 2 and the hammer link 3 is impossible and a fixing of the firearm is prevented, i.e., the pulling of the trigger 1 is still transferred to a movement of the trigger bar 2 but the trigger bar moves idly such that no force acts on the hammer link 3.

It is important that the movement between the two trigger bar positions (states) is provided reliably. The coupling between the actuator 20 and the trigger bar 2 is therefore important. In the following the mechanical linkage between the actuator 20 and the trigger bar 2 of preferred embodiments will be discussed in more detail.

According to a first aspect, a lever (or lever rod) 10 may be provided between the actuator 20 and the trigger bar 2. The lever 10 is preferably rotatably mounted to the actuator 20 and/or the trigger bar 2. Since the trigger bar 2 preferably moves (i) back and forth and (ii) up and down when the trigger is pulled and a cartridge is fired, it is preferred that the lever 1 is mounted between the actuator 20 and the trigger bar 2 in such a way that the trigger bar is allowed to move unhindered. In particular, it is preferred that connection between the trigger bar 2 and the lever 10 is a mere abutment. In other words, when the lever 10 abuts either directly or via intermediate parts against the trigger bar 2, it is possible that the trigger bar 2 acts like in a firearm without safety device, when the safety device is in the unlocked position. It is preferred that the movement or the force for firing the firearm is not deteriorated by the safety mechanism according to the present invention. For instance, it is preferred that the force for pulling and subsequently firing is as low as in conventional firearms since an increased "firing force" would result in shaking the firearm.

As briefly mentioned above, it is preferred that the trigger bar 2 is biased or supported by a trigger bar spring element, e.g., a spring which presses the trigger bar upwardly such that the engaging between the trigger bar 2 and the hammer link 3 is ensured. Such a trigger bar spring element is typically provided somewhere between the receiver and the trigger bar 2. In particular, it is preferred that the trigger bar spring is mounted at one side on the receiver and at the other side at the trigger bar or at a spring support element 16 which abuts against the trigger bar 2. However, when the trigger bar 2 is actively moved to the second or secured position, e.g., downwardly, the actuator 2 has to move against the spring force of the trigger bar support spring 15. It is therefore preferred that the trigger bar support spring 15 is not mounted directly at the receiver, but mounted at the lever 10. In other words, when the lever 10 moves from the first to the second position, the mounting points of the trigger bar support spring move as well, i.e., the actuator 20 does not move against the pressure force of the trigger bar support spring. This is advantageous since actuators providing lower forces can be used.

FIGS. 1 to 6 show a preferred embodiment according to the present invention, wherein the lever 10 comprises a substantially rectangular lever frame 19. A spring support element 16 is provided movably within the lever frame 19. The spring support element 16 is biased upwardly by the trigger bar support spring 15 provided between the spring support element 16 ant the lever frame 19. The spring support element 16 preferably comprises a support pin 12 for abutting against the trigger bar 2. In other words, the trigger bar support spring 15 is mounted at the frame 19 for urging the trigger bar 2 upwardly. The force of the spring is preferably transmitted by means of intermediate parts, i.e., parts between the frame 19 and the trigger bar. For instance, the spring force is exerted to the trigger bar 2 via support spring support element 16 and support pin 12 to the trigger bar. Since the trigger bar 2 moves back and forth, it is preferred that the abutting or connection point between the spring support element 16 and the trigger bar is as small as possible such so that friction is avoided and the force for firing a cartridge is not increased. In order to further reduce the frictional force between the support pin 12 and the trigger bar, the support pin may be rotatably mounted with regard to the spring support element such that the support pin 12 rotates when the trigger bar moves back and forth. According to yet a further embodiment, the support pin may comprise a bushing 13 such that the bushing rotates around the support pin 12 when the trigger bar 2 moves back and forth.

The safety device according to the present invention may comprise any input means for receiving an authentication code. According to a preferred embodiment of the present invention, the safety means receives, via antenna 41, a preferably enerpypted authentication signal from an external transmitter or transponder. FIG. 7 shows a transponder 100 worn by an authorized user as a wristwatch. The transponder can also be adapted otherwise to be carried by an authorized user of the firearm, or as an alternative the transponder 100 can be installed in an area where one or more users of a firearm are allowed to use the firearm, e.g. in a shooting stand. This has the advantage that a localization can be achieved by an installation of one or more transponder stations at fixed positions, e.g. in a riflemen's club-house.

The transponder 100 emits an authenticating signal to the safety means in case the user is authorized to use said firearm 42. The safety device receives and further processes the authenticating signal from the transponder 100 to permit firing of the firearm 42 by the user in case the authenticating signal from the transponder 100 authenticates an authorized user.

In an embodiment of the invention, the safety device comprises an electronic control unit to control the safety device, in particular the actuator 20. When the safety device receives the authenticating signal from the transponder 100, said signal is processed in the electronic control unit which actuates the actuator 20 to actively move the trigger bar 20 from the second position to the first postion, in case a user is identified as authorized thereto.

In case the user of the firearm 42 is not authorized, the transponder 100 emits no signal or a signal which does not authenticate the user as authorized. In the latter case the safety device which has received the signal from the transponder 100 recognizes that the signal is not an authenticating signal and therefore causes the actuator of the firearm to actively move the trigger bar 2 to the safety or second position (state). In an embodiment the transponder 100 does not send a signal in case a user is not authorized. Thus the firearm 42 remains blocked since the safety device does not receive an authenticating signal from the transponder 100 and the trigger bar remains in the secure (second) position.

In a preferred embodiment of the invention the safety device and the transponder 100 communicate with each other by a bidirectional wireless signal transmission which is more preferably based on a challenge response algorithm. This has the advantage that the reliability of the identification can be further improved.

In an embodiment of the invention the transponder 100 comprises a biometric sensor for example a fingerprint sensor to identify an authorized user before the transponder 100 is activated for a given period of time to emit an authenticating signal. This has the advantage that the security can be further improved since an unauthorized user cannot activate the transponder 100 to emit an authenticating signal. Furthermore, additional security features can be integrated in the transponder 100 such as, e.g., the biometric sensor described above to verify if a user of the transponder 100 is authorized thereto etc. without the necessity of changing the construction of the firearm. Some other additional security features will be described in the following.

As an alternative to the biometric sensor or in addition thereto, the transponder 100 can be provided with a key (keys) to enter a personal code(s) (e.g. a PIN-code) for identifying an authorized user before the transponder 100 is activated to emit an authentication signal. It is clear that the invention is not limited to the biometric sensor and the keys for entering a code(s) to identify an authorized user(s) of the transponder. Any other sensors or devices suitable to identify an authorized user are within the scope of the invention.

The transponder 100 can be further configured to provide an authenticating signal within a certain range "A" as depicted in FIG. 7, preferably up to 10 m (e.g. in a shooting stand), more preferably up to 5 m, even more preferably up to 1.5 m or more preferably up to 30 cm. This is advantageous for example when the transponder 100 has a fixed position, e.g., in a shooting stand in which the transponder 100 is used to activate a firearm (firearms) therein. This allows, e.g., that a transponder 100 can be located or worn in a protected area in which the transponder 100 is protected e.g. from being damaged or from attempts of manipulation etc. so that the transponder 100 can be activated and emit an authenticating signal to the safety means of the firearm 42, e.g., outside said protected area. It is clear that the range in which the transponder 100 is configured to provide an authenticating signal can be varied depending on the field for which the transponder is used. That means that the invention is not limited to the range as mentioned above but can also provide a range considerably larger or smaller.

As mentioned before the transponder 100 can be adapted to be carried or worn by a user e.g. on the body, in a pocket or as a ring or a bracelet etc. As an alternative the transponder 100 can be also adapted to be mounted e.g. in an area for using firearms such as e.g. a shooting stand or in a private area or in a particular protected area.

In an embodiment of the invention the transponder 100 can be configured to be used for different users of the firearm of the safety device. This has the advantage that one transponder 100 can be used for different users of a firearm 42.

Preferably the transponder 100 and/or the safety means correspond with each other and/or are programmable in order to authorize a user or a group of users. The transponder 100 and/or the safety means communicate with each other and/or are preferably programmable on a wireless basis.

In a further embodiment of the invention different transponders can be used for different users of the firearm of the safety device. This has the advantage that the firearm 42 can be actuated by different users having their own transponder 100.

In a further embodiment of the invention, the request signal and/or the authenticating signal can be communicated by a frequency of approximately 25 kHz.

Furthermore, the safety means of the invention can be adapted to permit firing of the firearm 42 under certain conditions once the safety means has received an authenticating signal from an authorized user.

As an alternative or in addition the safety device can permit firing of the firearm 42, e.g. for a given number of shoots and/or for a given period of time and/or in a certain transmitting range which must not be left by the user (e.g. a range of preferably approximately 80 cm when the transponder is not installed at a fixed position and a range up to 1.5 m in case the transponder is located at a fixed position). Preferably the given period of time and/or number of shots can be varied for different transponders 100 of different users of the firearm.

More preferably, the past activity of the firearm 42 can be documented. In this case, the safety means can be regularly interrogated or inquired.

Further, the activities of the transponder 100 and/or the safety means are preferably logged and readable by a computer. This has the advantage that the activities of the firearm can be reconstructed and e.g. directly stored in the computer similar to a black box in airplanes.

Moreover, the transponder 100 can be adapted to also communicate with a compartment for firearms, such as a locker, in order to give an authorized person access to the compartment. This has the advantage, that the transponder 100 can be also used to prevent that an unauthorized user can open the compartment for firearms.

It is obvious for the person skilled in the art that the present invention is not limited by what has been particularly shown and described hereinabove. Rather the scope of the present invention includes both combinations and sub-combinations of the features described hereinabove as well as modifications and variations thereof which would occur to a person skilled in the art upon reading the foregoing description and which are not comprised in the prior art.

The invention claimed is:

1. Safety device for a firearm with the following features:

i) a trigger bar in said firearm moves in response to a pulling of a trigger, ii) an actuator in said firearm which is adapted for actively moving said trigger bar between a first position and a second position (state), wherein iii) said trigger bar engages in the trigger induced movement with hammer link for releasing a hammer and firing a cartridge bullet when the trigger bar is in the first position, and iv) said trigger bar does not engage in the trigger induced movement with the hammer link such that the cartridge bullet is not fired when the trigger bar is in the second position, v) wherein the actuator moves (displaces) the trigger bar from the first position to the second position by means of a lever means, vi) wherein a trigger bar spring element is provided between the lever means and the trigger bar such that the trigger bar spring element applies a force between the trigger bar and the lever means.

2. Safety device according to claim 1, wherein said actuator is at least one of the group consisting of a mechanical actuator, an electromechanical actuator, a one-wire element comprising a shape memory alloy, an electric motor, a piezoelectric actuator, a magnet and an electromagnet.

3. The device of claim 1, wherein said force is substantially equal irrespective of whether the trigger bar is in the first or second position.

4. Safety device according to claim 2, wherein the lever means is connected with a rotatable lever element which engages with the trigger bar and is adapted for moving the trigger bar between the first and second position by rotational movement of the rotatable lever element.

5. Safety device according to claim 4, wherein the rotatable lever element comprises a rotation axis and a working point displaced from the rotation axis, wherein said working point is connected to the lever means such that a movement of the lever means results in a rotational movement of the rotatable element around the rotation axis.

6. Safety device according to claim 4, wherein said rotational lever element comprises a cam element and wherein the trigger bar and the rotational lever element engage via substantially planar surfaces in the first state of the trigger bar, wherein a small rotational movement of the rotational lever element results in a larger vertical movement of the trigger bar due to lever actions.

7. Safety device according to claim 3, wherein the lever means comprises a frame for movably supporting a spring support element, wherein said spring support element is adapted to transfer forces from the trigger bar via the trigger bar spring element to the frame.

8. Safety device according to claim 7, wherein the spring support element comprises a support pin such that the support element engages with the trigger bar via said support pin.

9. Safety device according to claim 8, wherein a bushing is provided around said support pin such that the support element engages with the trigger bar via said support pin and said bushing.

10. Safety device according to claim 5, wherein the working point and the rotational axis are in line with the lever means when the trigger bar is in the second position.

11. Safety system comprising:

a safety device according to claim 1, a transponder for authenticating at least one authorized firearm user carrying the transponder.

12. The system according to claim 11, wherein the transponder is adapted to emit a wireless preferably cryptified authenticating signal and communicate with each by a bidirectional wireless signal transmission.

13. Method for unlocking a firearm, particularly for operating a safety device according to claim 1, with the following steps:

providing a safety device in the firearm, providing a transponder which is adapted to emit a wireless cryptified authenticating signal which authenticates at least one authorized firearm user for using the firearm, emitting the authenticating signal by the transponder to the safety device, receiving and processing the authenticating signal from the transponder at the safety device, and actively moving the trigger bar by means of an actuator into the first position upon receipt of an authenticating signal from the transponder authenticating an authorized user such that firing of the firearm is permitted.

14. Method for securing a firearm, particularly for operating a safety device according to claim 1, with the following steps:

providing the safety device in the firearm;

and when no authenticating signal is received by the safety device, actively moving the trigger bar by means of an actuator to the second position such that firing of the firearm is not possible.

* * * * *

UNITED STATES PATENT AND TRADEMARK OFFICE

CERTIFICATE OF CORRECTION

PATENT NO. : 8,549,780 B2
APPLICATION NO. : 12/921654
DATED : October 8, 2013
INVENTOR(S) : Emde et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 492 days.

Signed and Sealed this
Fifteenth Day of September, 2015

Michelle K. Lee

Michelle K. Lee
*Director of the United States Patent and Trademark Office*